US008802002B2

(12) United States Patent
Berrigan et al.

(10) Patent No.: US 8,802,002 B2
(45) Date of Patent: Aug. 12, 2014

(54) DIMENSIONALLY STABLE BONDED NONWOVEN FIBROUS WEBS

(75) Inventors: Michael R. Berrigan, Oakdale, MN (US); John D. Stelter, St. Joseph Township, WI (US); Ruth A. Ebbens, Hudson, WI (US); Sian F. Fennessey, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 554 days.

(21) Appl. No.: 11/617,274

(22) Filed: Dec. 28, 2006

(65) Prior Publication Data

US 2008/0160861 A1 Jul. 3, 2008

(51) Int. Cl.
*D01D 5/08* (2006.01)

(52) U.S. Cl.
USPC ..... 264/555; 264/172.11; 264/345

(58) Field of Classification Search
USPC ..... 264/639
See application file for complete search history.

(56) References Cited

U.S. PATENT DOCUMENTS

| | | | | |
|---|---|---|---|---|
| 3,823,210 | A | 7/1974 | Shii et al. | |
| 3,971,373 | A | 7/1976 | Braun | |
| 3,978,185 | A | 8/1976 | Buntin et al. | |
| 4,042,740 | A | 8/1977 | Krueger | |
| 4,118,531 | A | 10/1978 | Hauser | |
| 4,429,001 | A | 1/1984 | Kolpin et al. | |
| 4,622,259 | A | 11/1986 | McAmish et al. | |
| 5,010,165 | A | 4/1991 | Pruett et al. | |
| 5,244,482 | A | 9/1993 | Hassenboehler, Jr. et al. | |
| 5,328,653 | A | 7/1994 | Hyde et al. | |
| 5,405,921 | A | 4/1995 | Muschiatti et al. | |
| 5,702,826 | A * | 12/1997 | Ehret et al. | 428/515 |
| 5,753,736 | A * | 5/1998 | Bhat et al. | 524/287 |
| 5,958,322 | A | 9/1999 | Thompson et al. | |
| 6,667,254 | B1 | 12/2003 | Thompson, Jr. et al. | |
| 6,770,356 | B2 | 8/2004 | O'Donnell et al. | |
| 6,916,752 | B2 | 7/2005 | Berrigan et al. | |
| 2004/0097155 | A1 | 5/2004 | Olson et al. | |
| 2004/0115431 | A1 | 6/2004 | Chen et al. | |

FOREIGN PATENT DOCUMENTS

| | | |
|---|---|---|
| EP | 0 893 517 | 1/1999 |
| JP | 3-45768 | 2/1991 |
| JP | 5-171556 | 7/1993 |
| JP | 7-3534 | 1/1995 |
| KR | 10-0581637 | 5/2006 |

(Continued)

OTHER PUBLICATIONS

E. B. Gowd et al., Effect of molecular orientation on the crystallization and melting behavior in poly(ethylene terephthalate), Sep. 3, 2004, Polymer, vol. 45, Issue 19, pp. 6707-6712.*

U.S. Patent Application entitled "Bonded Nonwoven Fibrous Webs Comprising Softenable Oriented Semicrystalline Polymeric Fibers and Apparatus and Methods for Preparing Such Webs," filed Jul. 17, 2006, having U.S. Appl. No. 11/457,899.

(Continued)

*Primary Examiner* — Monica Huson

(74) *Attorney, Agent, or Firm* — James A. Baker; John M. Bronk

(57) ABSTRACT

A method for making a bonded nonwoven fibrous web comprising extruding melt blown fibers of a polymeric material, collecting the melt blown fibers as an initial nonwoven fibrous web, annealing the initial nonwoven fibrous web with a controlled heating and cooling operation, and collecting the dimensionally stable bonded nonwoven fibrous web is described. The bonded nonwoven fibrous web shrinkage is typically less than 4 percent relative to the initial nonwoven fibrous web.

9 Claims, 5 Drawing Sheets

(56) References Cited

FOREIGN PATENT DOCUMENTS

| | | | |
|---|---|---|---|
| WO | WO 98/50611 | | 11/1998 |
| WO | WO 02/46504 | A1 | 6/2002 |
| WO | WO 2008/085544 | | 7/2008 |

OTHER PUBLICATIONS

U.S. Patent Application entitled "Fibrous Web Comprising Microfibers Dispersed Among Bonded Meltspun Fibers," filed Jul. 31, 2006, having U.S. Appl. No. 11/461,192.

* cited by examiner

DIMENSIONALLY STABLE BONDED NONWOVEN FIBROUS WEBS

FIELD

The present invention relates to bonded nonwoven fibrous webs.

BACKGROUND

Typical melt spinning polymers, such as polyolefins, tend to be in a semi-crystalline state upon meltblown fiber extrusion (as measured by differential scanning calorimetry (DSC)). For polyolefins, this ordered state is due, in part, to a relatively high rate of crystallization and the extensional polymer chains oriented in the extrudate. In meltblown extrusion, extensional orientation is accomplished with high velocity, heated air in the elongational field. Extending polymer chains from the preferred random coiled configuration and crystal formation imparts internal stresses to the polymer. Provided the polymer is above its glass transition temperature ($T_g$) these stresses will dissipate. For meltblown polyolefins, the dissipation of stresses occurs spontaneously within a few days of web formation since the polymer's $T_g$ is well below room temperature.

Melt blown polyethylene terephthalate (PET) generally exhibits a level of crystalline orientation commensurate with the strain level imparted during processing, and the time available for the polymer chains to relax during cooling. PET has a relatively slow rate of relaxation, a relatively low rate of crystallization, a relatively high melt temperature ($T_m$), and a glass transition temperature ($T_g$) above room temperature. The internal stresses from amorphous orientation within the elongational field are frozen-in place due to rapid cooling of the melt, thus retarding relaxation. As the $T_g$ is approached and surpassed, the chains begin to relax. Annealing between $T_g$ and $T_m$ for a sufficient period of time allows the polymer to dissipate the internal stresses caused by elongational orientation, and for the chains to crystallize. The stress dissipation manifests itself in the form of shrinkage of the web's extruded dimensions, while crystallization of the polymer chains increases brittleness.

Efforts to provide a more stable and useful meltblown PET fiber, such as annealing a web while being held on a tentering structure has been described in U.S. Pat. No. 5,958,322 (Thompson et al.), or forming strain induced crystals during fiber attenuation as described in U.S. Pat. No. 6,667,254 (Thompson, Jr. et al.) and Japanese Kokai No. 3-45768. Other techniques for extracting soluble fractions of drawn crystalline polymer in a heated solvent and applying a tensile stress to provide for a stable polyester nonwoven fibrous web have been described in U.S. Pat. No. 3,823,210 (Hikaru Shii et al.), and by treating webs in solvent as described in U.S. Pat. No. 5,010,165 (Pruett et al.).

SUMMARY

The melt blown fibers of this disclosure are substantially free of strain induced crystallization, and are substantially unoriented in the bonded nonwoven fibrous web. In one aspect, this disclosure provides for a method for making a bonded nonwoven fibrous web comprising extruding a mass of melt blown fibers of a polymeric material, collecting the mass of melt blown fibers as an initial nonwoven fibrous web, where the fibers are substantially free of strain induced crystallization, annealing the initial nonwoven fibrous web with a controlled heating and cooling operation and collecting the dimensionally stable bonded nonwoven fibrous web. The controlled heating and cooling operation includes heating through the nonwoven fibrous web with a first fluid having a temperature above $T_{cc}$ (cold crystallization temperature) of the polymeric material to decrease the orientation of the amorphous regions of the melt blown fibers forming a bonded nonwoven fibrous web, and cooling through the bonded nonwoven fibrous web with a second fluid having a temperature below the $T_g$ of the polymeric material to retain the amorphous regions of the melt blown fibers.

In one embodiment, the dimensionally stable bonded nonwoven fibrous web shrinkage is less than 4 percent relative to the initial nonwoven fibrous web.

In one embodiment, the initial nonwoven fibrous web, the heated nonwoven fibrous web, the bonded nonwoven fibrous web, the cooled bonded nonwoven fibrous web, and the dimensionally stable bonded nonwoven fibrous web are unrestrained.

In another aspect, a bonded nonwoven fibrous web is described. The web comprises melt blown fibers having a diameter in a range from 1 to 20 micrometers. The fibers are substantially free of strain induced crystallization.

Nonwoven fibrous webs that are typically amorphous, such as polyethylene terephthalate (PET), tend to be in a nearly amorphous state upon melt blown fiber extrusion. The internal stresses from amorphous orientation within the elongational field are frozen-in due to rapid cooling of the melt, thus preventing relaxation, which cannot be released until subsequent annealing above $T_g$. Annealing between the $T_g$ and the $T_m$ for sufficient periods allows the polymer to both crystallize and dissipate internal stresses caused by elongational orientation. This stress dissipation manifests itself in the form of shrinkage that can approach values exceeding 50 percent of the web's extruded dimensions.

The fibers of this disclosure are substantially free of strain induced crystallization, and are substantially unoriented in the bonded nonwoven fibrous web. The fibers exiting the extruder die typically lack chain extension, and thus exhibit reduced amorphous orientation in the polymer chains as they are collected. The fibers of the web soften during the controlled heating step to provide for bonding between the fibers, and for reduced orientation of the amorphous regions of the fibers. The fibers are relaxed for a period of time at a temperature above $T_{cc}$ of the polymeric material. Immediately following the heating step, the fibers are cooled to a temperature below the $T_g$ of the polymeric material to retain or lock in the reduced amorphous orientation resulting from the heating step above. The controlled heating and cooling operation provides for a dimensionally stable bonded nonwoven fibrous web.

DETAILED DESCRIPTION

Figure 1:
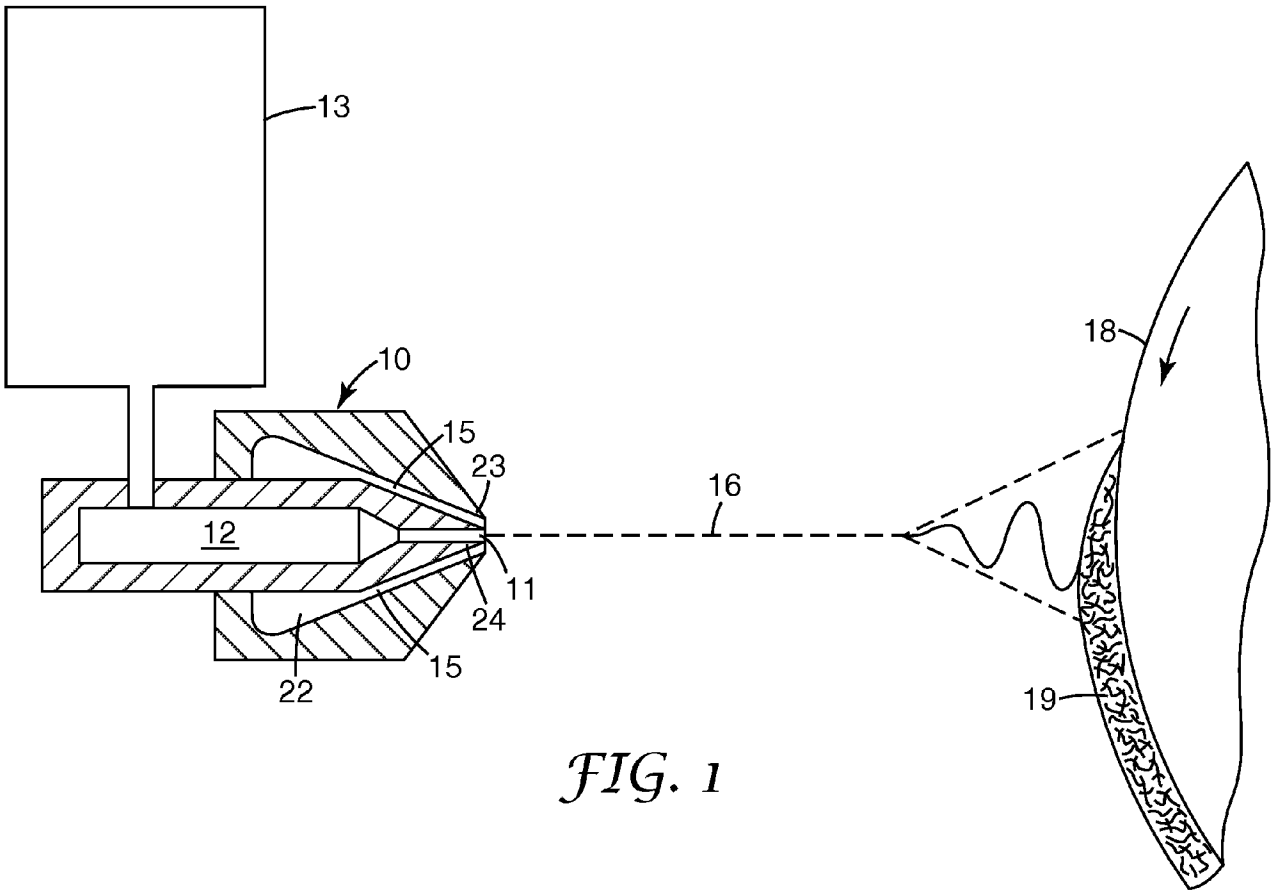
FIG. 1 is a schematic representation of a meltblown fiber apparatus for forming a nonwoven fibrous web.

For the following defined terms, these definitions shall be applied, unless a different definition is given in the claims or elsewhere in the specification.

The term "annealing" refers to a process of heating and/or cooling a polymeric material to a temperature to influence a set or one of desired properties. For example, a material may be annealed at a temperature to relax the polymer chains and subsequently cooled at a lower temperature to retain the properties achieved at the higher temperature.

The term "cold crystallization temperature ($T_{cc}$)" refers to the temperature where the amorphous regions of polymer chains organize and orient above the $T_g$ of a polymer as illustrated in a DSC (Differential Scanning Calorimetry) plot.

The term "cooling immediately" refers to rapidly cooling or quenching of melt blown fibers to retain their amorphous orientation without an intervening time interval following the heating operation. In one embodiment, the gas-withdrawal equipment is positioned down web from the heated gaseous stream so as to draw a cooling gas or other fluid, e.g., ambient air, through the web promptly after it has been heated and thereby rapidly quench the fibers. The length of heating is controlled, e.g., by the length of the heating region along the path of web travel and by the speed at which the web is moved through the heating region to the cooling region, to cause the intended softening and relaxing of the amorphous regions of the fibers.

The term "dimensionally stable" refers to a nonwoven fibrous web that exhibits preferably less than 4 percent shrinkage, more preferably less than 2 percent shrinkage, and most preferably less than 1 percent shrinkage, along it major surface when elevated to a temperature above the temperature at which the nonwoven fibrous web was annealed. The webs were prepared according to ASTM D 3776-96 and tested for shrinkage in accordance with ASTM D 1204-84. Table 2 shows the results of web shrinkage testing.

The term "forcefully passing" refers to passing a liquid or gaseous stream through a web at a force in addition to the normal room pressure as applied to the fluid to propel the fluid through the web. The annealing step of the method includes passing the web on a conveyor through a device (e.g., through air bonder) that provides a focused or knife-like heated gaseous stream issuing from the heater under pressure and engaging one side of the web, with gas-withdrawal apparatus on the other side of the web to assist in drawing the heated gas through the web. Generally, the heated stream extends across the width of the web. The heated stream may be subjected to special controls that modulate the flow, causing the heated gas to be distributed uniformly and at a controlled rate through the width of the web to thoroughly, uniformly and rapidly heat the fibers of the web to a usefully high temperature.

The term "glass transition temperature ($T_g$)" refers to the temperature where a polymer changes to a viscous or rubbery condition from a glassy one.

The term "heating" refers to precisely controlled heated air (controlled volume, velocity, and temperature) of a through air bonder device.

The term "melting point or melting transition temperature ($T_m$)" refers to the temperature where the polymer transitions from a solid phase to a liquid phase.

The term "microfiber" refers to fibers having an effective fiber diameter of less than 20 micrometers.

The term "nonwoven fibrous web" refers to a textile structure produced by mechanically, chemically, and/or thermally bonding or interlocking polymeric fibers.

The term "period of time" refers to a predetermined amount of time to perform a desired function. For example, the nonwoven web of this disclosure is heated for a "period of time" to relax the amorphous orientation of the polymer chains and/or allow for bonding of the fibers of the web.

The term "polymeric" refers to a material that is not inorganic and contains repeating units, and further includes polymers, copolymers, and oligomers.

The term "substantially free" refers to zero or nearly no detectable amount of a material, quantity, or item. For example, the amount can be less than 2 percent, less than 0.5 percent, or less than 0.1 percent of the material, quantity, or item.

The term "substantially unoriented" refers to zero or nearly no detectable amount of a material, quantity, or item. For example, the amount can be less than 2 percent, less than 0.5 percent, or less than 0.1 percent of the material, quantity, or item.

The term "thermoplastic" refers to a polymeric material that reversibly softens when exposed to heat.

The term "unrestrained" refers to a condition wherein the web or fibers are not held or not restrained by a device, such as a tentering structure to achieve fiber orientation and crystallization.

The recitation of numerical ranges by endpoints includes all numbers subsumed within that range (e.g., 1 to 5 includes 1, 1.5, 2, 2.75, 3, 3.8, 4 and 5).

As included in this specification and the appended claims, the singular forms "a", "an", and "the" include plural referents unless the content clearly dictates otherwise. Thus, for example, reference to a composition containing "a compound" includes a mixture of two or more compounds. As used in this specification and appended claims, the term "or" is generally employed in its sense including "and/or" unless the content clearly dictates otherwise.

Unless otherwise indicated, all numbers expressing quantities or ingredients, measurement of properties and so forth used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings of the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains errors necessarily resulting from the standard deviations found in their respective testing measurements.

A representative apparatus useful for preparing meltblown fibers or a melt blown fibrous web of this disclosure is illustrated in FIG. 1. Part of the apparatus, which forms the blown fibers, can be as described in Wente, Van A., "Superfine Thermoplastic Fibers" in *Industrial Engineering Chemistry*, Vol. 48, page 1342-1346 (1956), and in Report No. 4364 of the Navel Research Laboratories, published May 25, 1954, entitled "Manufactured of Superfine Organic Fibers" by Wente, V. A. et al. This portion of the illustrated apparatus comprises a die 10 which has a set of aligned side-by-side parallel die orifices 11, one of which is seen in the sectional view through the die. The orifices 11 open from the central die cavity 12. Fiber-forming material is introduced into the die cavity 12 from an extruder 13. An elongated (perpendicular to the page) opening or slot 15 disposed on either side of the row of orifices 11 conveys heated air at a very high velocity. Outer die lip 23 provides a structural limitation or feature for the dimension of slot 15, and inner die lip 24 provides a structural limitation or feature to assist in controlling the diameter of the stream 16 as it exits 11. The air of slot 15, called the primary air, impacts onto the extruded fiber forming material, and rapidly combines the extruded material into a mass of fibers.

From the melt blowing die 10, the fibers travel in a stream 16 to a collector 18. The fibers exit the orifices 11 of the die cavity 12 at a temperature above the melting transition temperature, $T_m$. Within 0.5 to 5 cm of the orifices 11, the fibers of the stream 16 begin to decelerate, and generally cool below the $T_m$, where the fibers are substantially free of strain induced crystallization. As the melt blown fibers of the stream 16 approach the collector 18, they continue to decelerate, and generally approach temperatures below $T_g$ (glass transition temperature) without notable fiber shrinkage. The lack of fiber orientation or attenuation from the process may contribute to a lack of strain induced crystallization in the material. The fibers are collected on the moving collector 18 as a web or mass of melt blown fibers 19. The collector 18 may take the form of a finely perforated cylindrical screen or drum, or a moving belt. Gas-withdrawal apparatus may be positioned behind the collector to assist in deposition of fibers and removal of gas, e.g., the air in which the fibers are carried in the stream 16. Further details of the melt blowing apparatus of FIG. 1 are described in U.S. Pat. No. 6,667,254 (Thompson et al.).

The fibers of this disclosure are not drawn or attenuated before they move onto the collector 18. The primary air facilitates the movement and consolidation of fibers.

After deposition of the fibers in the stream 16 to a collector 18, the mass of fibers 19 is generally annealed as a web with a controlled heating and cooling operation.

Figure 2:
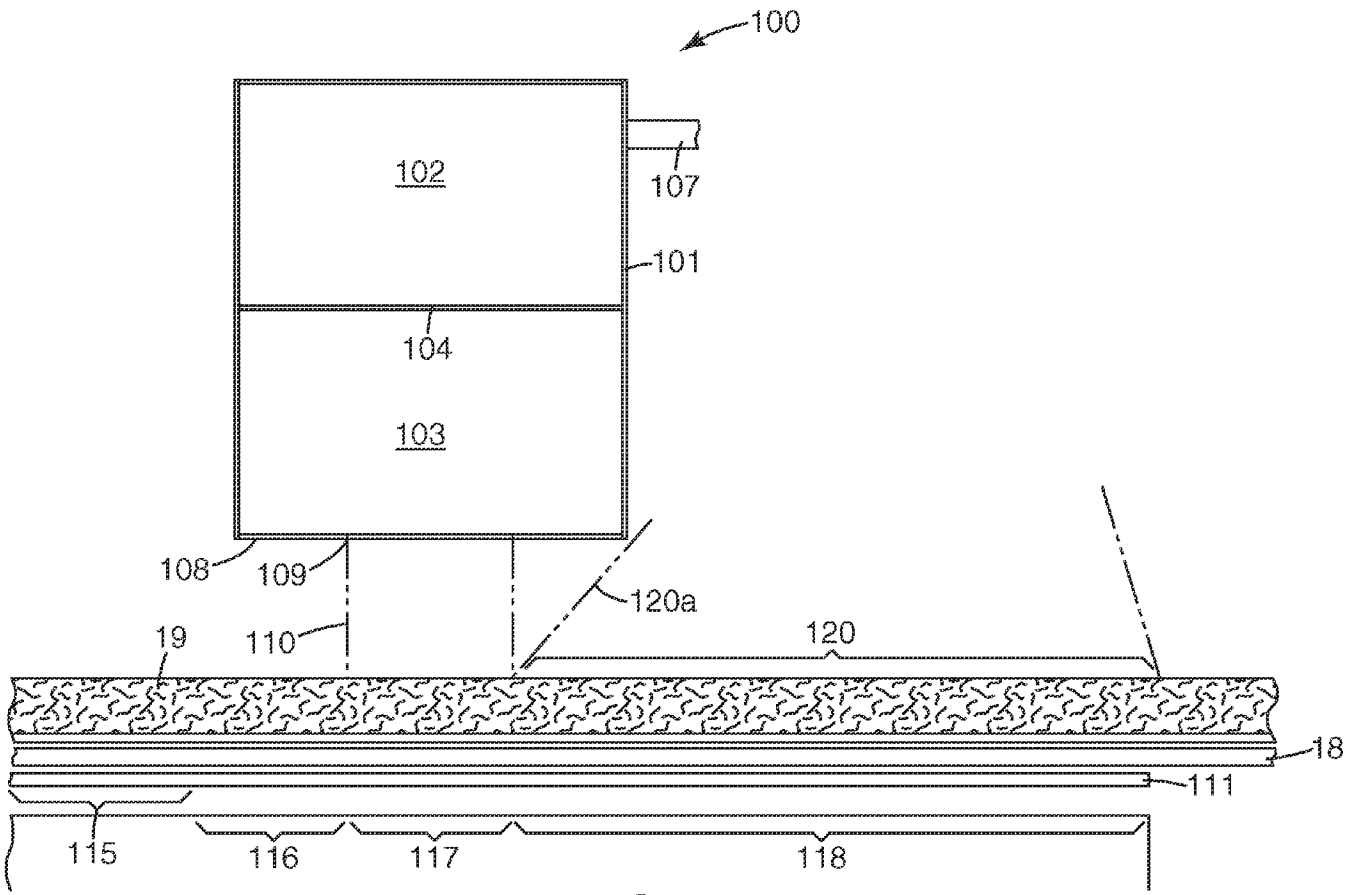
FIG. 2 is a schematic representation of an enlarged side view of a heat treating part of the apparatus of FIG. 1.
Figure 3:
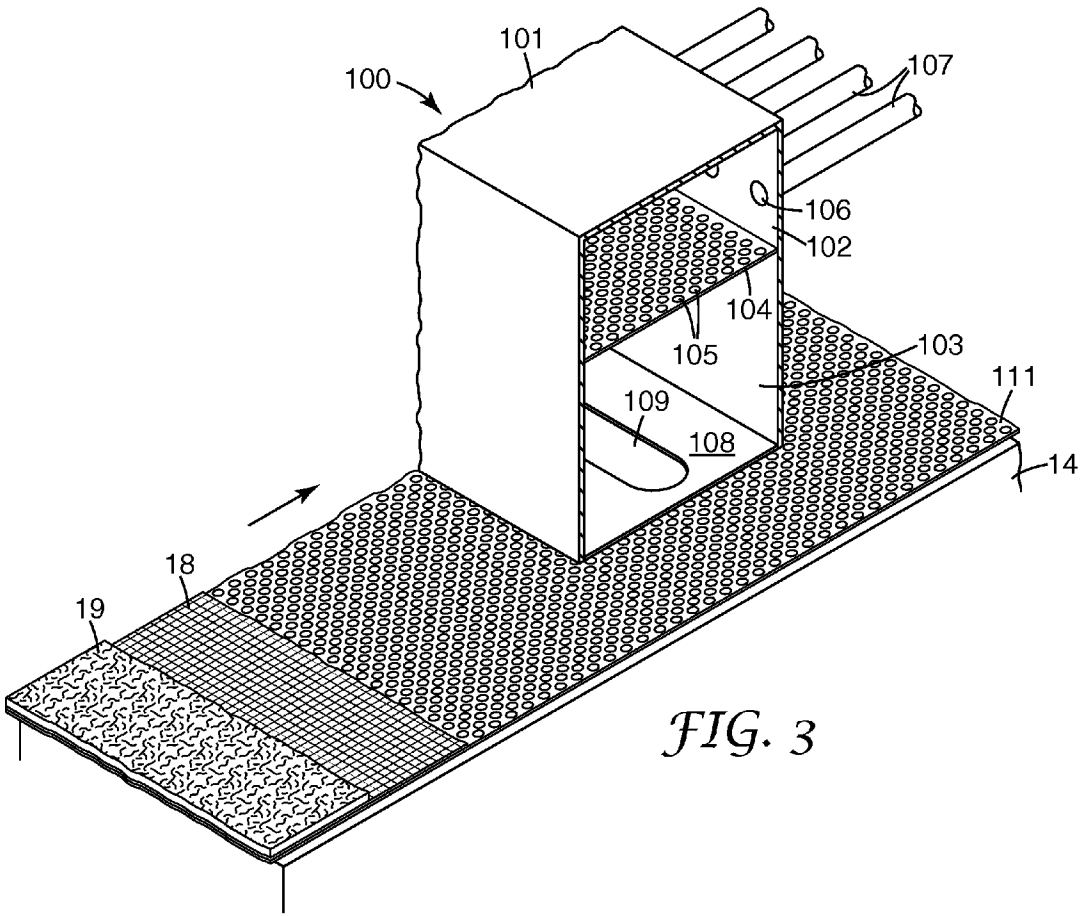
FIG. 3 is a schematic representation (perspective view) of the apparatus of FIG. 1.

In one aspect, the mass of melt blown fibers 19 is transported on the collector 18 and annealed through a heating and cooling operation as illustrated in FIG. 2 and FIG. 3. The apparatus in FIG. 2 and FIG. 3 is referred to as a quenched flow heater, quenched heater or through air bonder. The collected mass of fibers 19 is first passed under a controlled-heating device 100 mounted above the collector 18. The exemplary heating device 100 comprises a housing 101 that is divided into an upper plenum 102 and a lower plenum 103. The upper and lower plenums (102 and 103, respectively) are separated by a plate 104 perforated with a series of holes 105 that are typically uniform in size and spacing. A gas, typically air, is fed into the upper plenum 102 through openings 106 from conduits 107, and the plate functions as a flow distribution means to cause air fed into the upper plenum to be rather uniformly distributed when passed through the plate into the lower plenum 103. Other useful flow distribution means include fins, baffles, manifolds, air dams, screens or sintered plates, i.e., devices that even the distribution of air.

In the device 100 of FIG. 2 and FIG. 3, the bottom wall 108 of the lower plenum 103 is formed with an elongated slot 109 through which an elongated or knife-like stream 110 of heated air from the lower plenum is blown onto the mass of fibers 19 traveling on the collector 18 below the heating device 100 (the mass 19 and collector 18 are shown partly broken away in FIG. 3). FIG. 2 and FIG. 3 are further described in U.S. patent application Ser. No. 11/457,899 (Berrigan et al.), herein incorporated by reference. The gas-exhaust 14 preferably extends sufficiently to lie under the slot 109 of the heating device 100 (as well as extending down-web a distance 118 beyond the heated stream 110 and through an area marked 120). Heated air in the plenum is thus under an internal pressure within the plenum 103, and at the slot 109 it is further under the exhaust vacuum of the gas-exhausted device 14. To further control the exhaust force a perforated plate 111 may be positioned under the collector 18 to impose a kind of back pressure or flow-restriction means that contributes to spreading of the stream 110 of heated air in a desired uniformity over the width or heated area of the collected mass 19. Other useful flow-restriction means include screens or sintered plates.

The number, size and density of openings in the plate 111 of the collector 18 may be varied in different areas to achieve desired control. Large amounts of air pass through the fiber forming apparatus and must be disposed of in the region 115 as the fibers reach the collector. Sufficient air passes through the web and collector in the region 116 to hold the web in place under the various streams of processing air. Sufficient openness is needed in the plate under the heat treating region 117 and cooling 118 to allow treating air to pass through the web, while sufficient resistance remains to assure that the air is more evenly distributed.

The amount and temperature of heated air passed through the mass of fibers 19 is chosen to lead to an appropriate modification of the morphology of the fibers. Particularly, the amount and temperature are chosen so that the fibers reach a specified temperature by heating rapidly which will cause the fibers to soften and bond, as well as cause the fibers to relax their chains above the $T_{cc}$ to decrease the orientation of the amorphous regions. The heating operation is followed by immediately cooling or quenching the fibers below their $T_g$.

To achieve the intended fiber morphology change throughout the collected mass 19, the temperature-time conditions should be controlled over the whole heated area of the mass 19. Best results have generally been obtained when the temperature of the stream 110 of heated air passing through the web is within a range of 5° C., and preferably within 2° C. or even 1° C., across the width of the mass being treated (the temperature of the heated air is often measured for convenient control of the operation at the entry point for the heated air into the housing 101, but it also can be measured adjacent the collected web with thermocouples). In addition, the heating apparatus is operated to maintain a steady temperature in the stream over time, e.g., by rapidly cycling the heater on and off to avoid over- or under-heating. Preferably, the temperature is held within 1° C. of the intended temperature when measured at one second time intervals. The temperature of the stream 110 of the heating operation is typically from 80° C. to 400° C., more preferably from 90° C. to 300° C., and most preferably from 100° C. to 275° C., sufficient to relax the polymer chains and substantially remove or reduce any strain induced crystallization or amorphous orientation.

In one embodiment, the temperature of the mass of fibers 19 of the web (e.g., nonwoven fibrous web) as a result of the stream 110 ranges from 70° C. to 300° C., more preferably from 80° C. to 300° C., and most preferably from 90° C. to 285° C. The temperature of the fibers is sufficient to soften the fibers for bonding, and to relax the orientation of the amorphous regions of the polymer chains.

In order to further control the heating and to complete formation of the desired morphology of the fibers of the collected mass 19, the mass is then subjected to cooling immediately after the application of the stream 110 of heated air to quench the fibers into a substantially unoriented morphology. Such cooling can generally be obtained by drawing air over and through the mass 19 as the mass 19 leaves the controlled hot air stream 110. Numeral 120 of FIG. 2 represents an area in which ambient air is drawn by the air-exhaust device through the web. The gas-exhaust device 14 extends along the collector 18 for a distance 118 beyond the heating device to assure thorough cooling and cooling of the whole mass 19 in the area 120. Air can be drawn under the base of the housing 101, e.g., in the area marked 120*a* on FIG. 2, so that it reaches the web directly after the web leaves the hot air stream 110.

A purpose of the cooling is to rapidly remove heat from the web and the fibers, and thereby substantially limit the extent and nature of crystallization or molecular ordering that may subsequently occur in the fibers. Generally, annealing the web with a heating and cooling operation is performed while the web is moved through the operation on a conveyor, where cooling is performed before the web is wound into a storage roll at the end of the operation. The times of treatment depend on the speed at which a web is moved through an operation, but generally the annealing operation (heating and cooling) is performed in a minute or less, and preferably in less than 15 seconds. The annealing operation is more preferably performed in less than 5 seconds, even more preferably less than 0.5 seconds, and most preferably less than 0.001 seconds.

In one embodiment, by heating for a period of time and cooling immediately from the molten/softened state to a solidified state, the fibers are substantially unoriented and substantially free of strain induced crystallization. Desirably, the mass of fibers 19 is cooled by a fluid at a temperature of at least 100° C. less than the $T_g$ as determined by DSC. In one aspect, the cooling temperature ranges from −80° C. to 65° C., more preferably from −70° C. to 60° C., and most preferably from −50° C. to 50° C. Also, the cooling fluid is desirably applied for a time from 0.001 seconds to 15 seconds. The selected cooling fluid has sufficient heat capacity to rapidly solidify the fibers.

In one embodiment, the temperature of the fibers of the web range from −70° C. to 55° C. More preferably, the fiber temperature ranges from −60° C. to 50° C., and most preferably from −50° C. to 40° C. The fiber temperature is sufficient to retain the reduced amorphous orientation from the heating step described above.

A first fluid may be used to heat the nonwoven fibrous web, and a second fluid may be used to cool the nonwoven fibrous web. The first fluid and second fluid may be gases, liquids, or combinations thereof. The first fluid and second fluid may be the same fluid or different fluids for the heating and cooling of the web. Other fluids that may be used include water sprayed onto the fibers, e.g., heated water or steam to heat the fibers, and relatively cold water to cool or quench the fibers.

In one aspect, the annealing step comprises at least one of heating and cooling of the web. Additional annealing steps may be performed to affect the performance and properties of the web. Repeated annealing steps of heating and cooling will gradually reduce the $T_{cc}$ as shown in a DSC plot of the fibers of the nonwoven web.

In one embodiment, the mass of melt blown fibers are immediately annealed. Immediate treatment (annealing of the web with controlled heating and cooling) of the web prevents physical aging to occur in web samples. A lack of aging may be evidenced by the retention of flexibility and strength of a web after heat aging.

In another embodiment, the mass of melt blown fibers may be aged for a period of time, then treated or annealed (controlled heating and cooling). In this instance, the web may become brittle upon aging due to physical aging phenomenon. Evidence of physical aging may be found through DSC analysis showing an endotherm at the $T_{cc}$ and/or $T_m$ of the polymeric material. However, the dimension stability of the bonded nonwoven fibrous web is generally maintained.

In one aspect, the dimensionally stable bonded nonwoven fibrous web is unrestrained during the annealing step. The web may be continuous in order to be wound onto a roll or collected in a sheet form.

A method for making dimensionally stable nonwoven fibrous webs is described in U.S. Pat. No. 5,958,322 (Thompson et al.). Thompson describes crystallinity as a dimensional stability indicator for nonwoven fibrous webs, where tentering (e.g., the web is restrained on a tentering structure) was used to provide a dimensionally stable web. Further in Thompson, fibers of webs exhibit the greatest dimensional stability when the fibers are highly crystalline, and have the greatest dimension change when the web is totally amorphous. The webs of Thompson comprise strain induced crystals formed while annealing the web on a tentering structure.

Immediately after the heating and cooling operation, the web generally has a degree of bonding sufficient for the web to be handheld, e.g., removed from the collection screen and wound into a storage roll. In one aspect, the web may be collected onto a roll ranging from 2 meters per minute to 800 meters/minute, more preferably from 50 meters per minute to 600 meters per minute, and most preferably from 100 meters per minute to 300 meters per minute.

In one aspect, additional bonding or shaping of the fibers of the web may include providing it with a nonplanar shape or smoothing of its surface. The web may be configured into a persistent new configuration, i.e., a self-sustaining configuration that the web will generally retain during use. In some cases, shaping means smoothing one or both surfaces of the web and in some cases compacting the web. In other cases, shaping involves configuring the web into a nonplanar shape such as perhaps as a cup shape forming a shaped article for use as a face mask. The fibrous character of the web is retained during shaping, though the fibers may receive a somewhat different cross-section through the pressure of the shaping operation. A molded article of the web may result in the absence of a cold-crystallization peak in a DSC plot.

Confirmation of the desired annealing operation and resulting morphology of the amorphous characterized phase can be determined with DSC (Differential Scanning Calorimetry) testing of representative fibers from a treated web, where treatment conditions can be adjusted based on the results from DSC. DSC was used to examine changes occurring in the webs of this disclosure. Generally, a test sample (e.g., a small section of the fibrous web) is subjected to two heating cycles in the DSC equipment. A first heat is run where the sample as received is heated to a temperature greater than the melting point of the sample (as determined by the heat flow signal returning to a stable base line). The second heat, which is similar to the first heat, is conducted on the sample that was melted in the first heat and then cooled, typically to lower than room temperature. The first heat measures the characteristics of a nonwoven fibrous web of the disclosure directly after its completion, without having experienced additional thermal treatment. The second heat measures the basic properties of the material of the web, with any features that were imposed on the basic material by the processing to which the material was subjected during manufacture and treatment of a web of the disclosure having been erased by the melting of the sample that occurred during the first heat.

Figure 4:
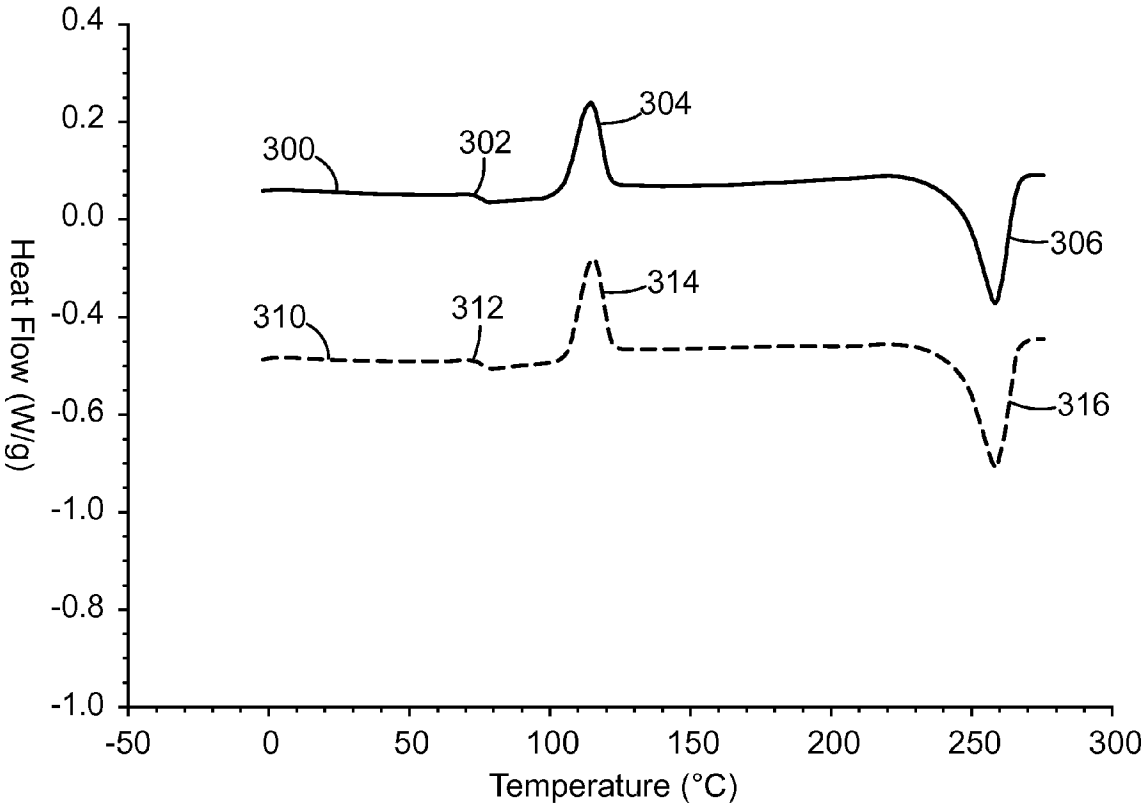
FIG. 4 is a plot obtained by Differential Scanning Calorimetry (DSC) on fibers from a poly(ethylene terephthlate) nonwoven fibrous web.

The webs were evaluated with Modulated Differential Scanning Calorimetry (MDSC) as illustrated in FIG. 4, where the method is further described in the Examples section. An untreated poly(ethylene terephthalate) (PET) web was analyzed in plot 310. The first heat scan of plot 310 shows a $T_g$ (312), a $T_{cc}$ (314), and a $T_m$ (316) at 80° C., 115° C., and 258° C., respectively. The untreated PET web was extruded and collected without the controlled heating and cooling operation of this disclosure.

Similarly, plot 300 illustrated in FIG. 4 shows a first heat scan of a treated PET web using the annealing process (heating and cooling operation) of this disclosure. In plot 300, the $T_g$ (302) at 80° C. shows an endotherm as the molecules in the sample's amorphous state transition from a glassy to a rubber state. At the $T_{cc}$ (304), the exotherm shows the molecules of the amorphous regions crystallizing or aligning at 115° C. The $T_m$ (306) shows an endotherm at 258° C. where the crystalline portions of the web melt. The controlled heating and cooling operation of this disclosure for the treated PET web (plot 300) sample shows no substantial shift in the $T_{cc}$ (304) or change in the size of the exotherm when compared to the untreated PET sample of plot 310. The melt blown fibers of the treated PET web retain a substantial cold crystallization exotherm. The $T_m$ (306) of plot 300 also shows no substantial shift in $T_m$ as well as no change in the size of the endotherm relative to the $T_m$ (316) of plot 310; both plots remained relatively the same. Plot 300 shows the annealing process does not appreciably affect the crystalline structure or morphology of the fibrous web relative to the untreated web of plot 310. Further, plot 300 shows no appreciable formation of strain induced crystals or chain extended crystals in the treated sample relative to plot 310 of the untreated PET web.

In one aspect, stepwise annealing may be needed to gradually relax the orientation of the amorphous segments present in the polymer fibers. The fibers of the web, which are heated for a period of time and immediately cooled, may require additional stepwise annealing treatment to reduce the $T_{cc}$.

Figure 5:
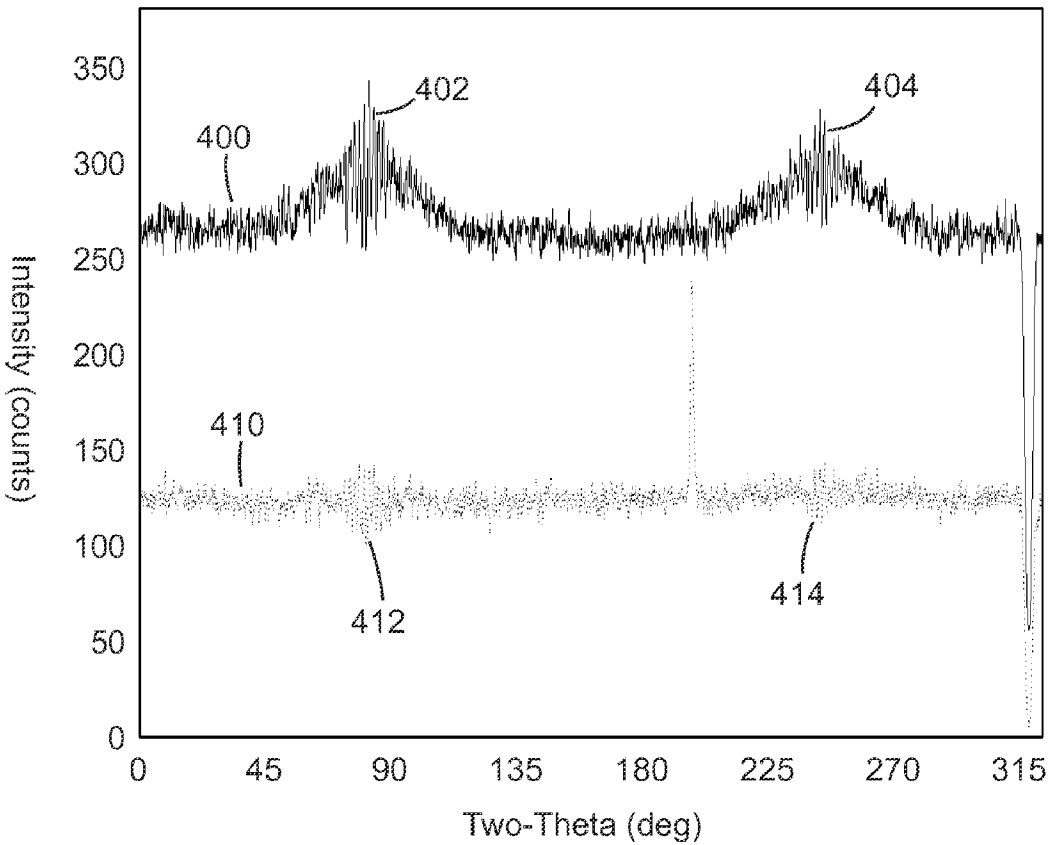
FIG. 5 is an azimuthal plot obtained by X-ray Diffraction (Reflectometry) of fibers from a poly(ethylene terephthalate) nonwoven fibrous web.

Further confirmation of the effect of heating and cooling on nonwoven webs was observed using X-ray diffraction scattering as described in the Examples section. In FIG. 5, azimuthal plots of the diffraction data for treated (410) and untreated (400) PET webs are illustrated. Individual fiber bundles were prepared and examined at 90° and 270° angles (to the long axis of the fibers) for determining the crystalline order of the polymer chains. Plot 400 shows the untreated (400) PET fibers possessing a low level of crystalline order, and uniaxial preferred orientation at a 90° angle (402) and a 270° angle (404), respectively. The treated (410) fibers of the PET web possess a lower level of crystalline order and uniaxial preferred orientation at a 90° angle (412) and a 270° angle (414) in contrast to the untreated (400) fibers. A plot of the treated (410) fibers also shows a lowering of the crystalline regions or a reduction in the orientation of the amorphous regions present in the fibers with the annealing process (heating and cooling operation) of this disclosure relative to untreated (400) PET fibers. Further, treated (410) PET fibers do not show an increase in the level of crystalline order or amorphous orientation.

Polymers suitable for use in this disclosure as polymeric material(s) include polyamides (e.g., nylon 6, nylon 6,6, nylon 6, 10); polyesters (e.g., polyethylene terephthalate, polyethylene naphthalate, polytrimethylene terephthalate, polycyclohexylene dimethylene terephthalate, polybutylene terephthalate, polylactic acid and other aliphatic polyesters); polyurethanes; acrylics; acrylic copolymers; polystyrene; polyvinyl chloride; polystyrene polybutadiene; polystyrene block copolymers; polyetherketones; polycarbonates; cyclic polyolefins and combinations thereof. The fibers of the fibrous web may be formed from a single thermoplastic material or a blend of multiple thermoplastic materials, such as, for example, a blend of one or more of the above listed polymers or a blend of any one of the above listed polymers and a polyolefin. In one aspect, the fibers are extruded to have multiple layers of different polymeric materials. The layers may be arranged concentrically or longitudinally along the fiber's length.

In one embodiment, the polymeric material comprises poly (ethylene terephthalate).

In one embodiment, the polymeric material comprises poly (lactic acid).

Fibers also may be formed from blends of materials, including materials into which certain additives have been blended, such as pigments or dyes. Bicomponent fibers, such as core-sheath or side-by-side bicomponent fibers, may be used ("bicomponent" herein includes fibers with two or more components, each occupying a cross section of the fiber and extending over the length of the fiber). However, this invention is most advantageous with monocomponent fibers (e.g., where the melt blown fibers are at least monocomponent), which have many benefits (less complexity in manufacture and composition), and can be conveniently bonded and given added bondability and shapeability. Different fiber-forming materials may be extruded through different orifices of the extrusion head so as to prepare webs that comprise a mixture of fibers. The use of staple fibers has permitted the preparation of thermally stable webs which maintain loft as described in U.S. Pat. No. 4,118,531 (Hauser et al.).

In one aspect, polyester meltblown nonwoven fibrous webs provide a unique combination of high strength, elongation, toughness, grab strength, and tear strength compared to other nonwoven polymeric webs, such as polypropylene nonwoven webs. Polyester nonwoven webs can be made with a high degree of rigidity or stiffness as compared to olefinic webs. This stiffness is inherent in polyester due primarily to its higher modulus values. Additionally, flame retardant properties are more easily imparted to polyester nonwoven fibrous webs as compared with olefinic fibrous webs.

The fibers prepared by the method of the disclosure may range widely in diameter. Microfiber sizes (about 10 micrometers or less in diameter) may be obtained and offer several benefits; but fibers of larger diameter can also be prepared, and are useful for certain applications. More preferably, the fiber diameters of this disclosure range from 1 micrometer to 20 micrometers, more preferably 1 micrometer to 10 micrometers, and most preferably 5 micrometers to 8 micrometers. Fibers of circular cross-section are most often prepared, but other cross-sectional shapes may also be used. The collected fibers may be continuous or essentially discontinuous.

The nonwoven fibrous webs described are dimensionally stable when processed above their $T_g$. The web shrinkage is typically less than 4 percent, more preferably less than 2 percent, and most preferably less than 1 percent, along its major surface when elevated to a temperature above at which the web was annealed. Samples for dimensional stability are described in the Examples section.

In one embodiment, the nonwoven fibrous web is thermally stable at a temperature up to 200° C., and further described in the Examples section.

Some webs of this disclosure may include particulate matter, as disclosed in U.S. Pat. No. 3,971,373 to provide enhanced filtration. The added particles may or may not be bonded to the fibers, e.g., by controlling process conditions during web formation or by later heat treatments or molding operations. The added particulate matter may also be a superabsorbent material such as taught in U.S. Pat. No. 4,429,001. In addition, additives may be incorporated into the fibers such as dyes, pigments, or flame-retarding agents.

Webs of this disclosure are especially useful as insulation, e.g., acoustic or thermal insulation. Webs comprising a blend of crimped fibers and oriented melt-blown fibers are especially useful in insulation and insulation applications. The addition of crimped fibers makes the web more bulky or lofty, which enhances insulating properties as described in U.S. Pat. No. 6,667,254 (Thompson et al.). Insulating webs disclosed are preferably 1 or 2 centimeters or more thick, though webs as thin as 5 millimeters in thickness have been used for insulating purposes. The substantially unoriented meltblown PET fibers described herein have a small diameter, which also enhances the insulating quality of the web by contributing to a large surface area per unit volume of material. The combination of bulk and small diameter gives good insulating properties. (Mixture of melt blown fibers and staple fibers are described in U.S. Pat. No. 4,118,531 (Hauser et. al.).

Because of their dimensional stability under thermal stress, webs of this disclosure are particularly suited for lining chambers such as automobile engine compartments or small and large appliance housings, e.g., air conditioners, dishwashers, and refrigerators. The webs also have increased tensile strength, durability and flexural strength. Their durability enhances their utility in insulation, providing, e.g., increased resistance to wear and launderability. Other illustrative uses for webs are as acoustical dampers, filters and battery separators.

The invention will be further clarified by the following examples which are exemplary and not intended to limit the scope of the invention.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Differential Scanning Calorimetry

Various measurements and tests were performed on representative nonwoven fibrous webs of the examples described below. Differential scanning calorimetry (DSC) was performed using a Modulated DSC™ system (Model Q1000 supplied by TA Instruments Inc., New Castle, Del.). Test samples of about 2-4 milligrams were cut from a test web with a razor blade and tested using the conditions as described below:

For Examples 1 and 2, and Comparative Examples C1 and C2, the samples were heated from −10° C. to 300° C. at a heating rate of 4° C./minute; a perturbation amplitude of plus-or-minus 0.636° C.; and a period of 60 seconds.

For Example 3 and Comparative Example C3, the samples were heated from −25° C. to 210° C. at a heating rate of 4° C./minute; a perturbation amplitude of plus-or-minus 0.636° C.; and a period of 60 seconds.

A heat-cool-heat test cycle was used for the test samples.

X-ray Scattering (XRD, WAXS, SAXS, GIXD, Reflectometry, Microdiffraction)

Samples examined in a transmission geometry configuration were prepared as individual fiber bundles. Fiber bundles were prepared by removing collections of individual fibers from nonwoven webs and aligning the long axis of the fibers to form fiber bundles.

Reflection geometry data was collected in the form of a survey scan by use of a Philips (Panalytical, Natick, Mass.) vertical diffractometer, copper Kα (alpha) radiation, and proportional detector registry of the scattered radiation. The diffractometer is fitted with variable incident beam slits, fixed diffracted beam slits, and graphite diffracted beam monochromator. The survey scan was conducted from 5 to 55 degrees (2θ) using a 0.04 degree step size and 8) second dwell time. Reflection geometry data were processed using Jade (version 7.5, MDI, Livermore, Calif.) software suite. Transmission geometry data was collected using a Bruker-AXS (Madison, Wis.) GADDS microdiffraction system, copper Kα (alpha) radiation, and HiStar 2D position sensitive detector registry of the scattered radiation. Samples were centered using a 6 cm sample to detector distance, where the detector was positioned at 0 degrees (2θ) with no sample tilt employed. A graphite monochromated 300 micron incident X-ray beam was employed at generator settings of 50 kV and 50 mA. Data was accumulated for two hours. Transmission 2D (two dimensional) data were analyzed using Bruker-AXS GADDS (version 4.1, Madison, Wis.) software. Three hundred sixty degree azimuthal traces of the 2D data were taken using a 0.1 degree (chi) step size over a 1.5 degree (2 theta or 2θ) wide scattering angle range.

Examples 1-3 and Comparative Examples 1-3

The nonwoven meltblown webs of the present invention can be prepared by a process similar to that taught in Wente, Van A., "Superfine Thermoplastic Fibers" in Industrial Engineering Chemistry, Vol. 48, pages 1342 et seq (1956), or in Report No. 4364 of the Naval Research Laboratories, published May 25, 1954 entitled "Manufacture of Superfine Organic Fibers" by Wente, Van. A. Boone, C. D., and Fluharty, E. L., except that a drilled die was preferably used. The thermoplastic material was extruded through the die into a high velocity stream of heated air which draws out and attenuates the fibers prior to their solidification and collection. The fibers were collected in a random fashion, such as on a perforated screen.

The apparatus shown in FIG. 1 was used to prepare fibrous webs from polyethylene terephthalate and polylactic acid. Examples 1-2 and Comparative Examples 1-2 (C1-C2) were prepared from poly(ethylene terephthalate) (PET) having a Melting Temperature ($T_m$) of 295° C. and an intrinsic viscosity of 0.61 (3M Polyester Resin 65100; 3M Company, St. Paul, Minn.). Example 3 and Comparative Example 3 (C3) were prepared from polylactic acid (PLA) Natureworks 6251D available from Natureworks, LLC, Minnetonka, Minn.

Example 4

Example 4 was identical to Example 1 with the addition of staple fibers into the web following the procedures taught by U.S. Pat. No. 4,118,531 (Hauser et al.). The staple fibers were from oriented poly(ethylene terephthalate) (4.7 decitex and a length of approximately 5 cm) crimped staple fibers (Kosa T224 fibers; Fiber Visions Incorporated, Covington, Ga.). The composition of the web was 50% by mass of the fibers of Example 2 and 50% staple fibers.

Formation and Treatment of Nonwoven Fibrous Webs

Certain parts of the apparatus and the operating conditions are detailed in Table 1. Apparatus parameters not reported in the table are as follows. The plate 104 of FIG. 2 contained ¼-inch-diameter (0.64 centimeter) holes at a uniform spacing of ⅜ inch (0.95 centimeter) such as to constitute 40% of the plate area. The collector 18 was a 50-inch-wide (1.27 meter), 40-mesh stainless steel woven belt in a chevron pattern having 0.43 mm by 0.60 mm openings (style 2055 from Albany International Engineered Fabrics, Portland, Tenn.).

Fibers were deposited on the collector belt to form a mass 19 having a width of about 22 inches (55.9 centimeters). Section 115 of the plate 111 underlying the belt 18 has a machine-direction length of 14.5 inches (36.8 centimeters), and contained 1.59-milliimeter-diameter holes on centers spaced 2.78 millimeters at a uniform spacing such as to constitute 30% of the plate area; section 116 had a length of 23.5 inches (about 60 centimeters) and contained 1.59-milliimeter-diameter holes on centers spaced 3.18 millimeters at a uniform spacing such as to constitute 23% of the plate area; and sections 117 and 118 together had a length of about 9 inches (about 23 centimeters) and contained 3.97-millimeter-diameter holes at a uniform spacing with centers spaced 4.76 millimeters such that the holes constituted 63% of the plate area; the machine-direction length of section 117 has a slot width in Table 1, 3.8 centimeters, leaving the length 118 of the quenching or cooling section as about 19.2 centimeters. The air-exhaust duct 14 of FIG. 3 had a width (transverse to the machine direction, which is the direction of movement of the collector belt) of 22 inches (55.9 centimeters) and a length sufficient for the distance 118 in FIG. 3 to be about 19 centimeters.

The heating face velocity reported in Table 1 was measured at the center of the slot 109 as shown in FIG. 3 at a point about one-half inch (1.27 centimeter) above the mass using a hot-wire anemometer; 10 measurements were taken over the width of the zone and arithmetically averaged. The cooling face velocity was measured in the same manner at the center (along the machine-direction axis) of the area 120 in FIG. 2. The temperatures reported in Table 1 for the heating zones 1-6 are temperatures of the air entering the box 101 from the conduits 107. There were six conduits 107 and temperature of input air was measured at the entry point to the box 101 by open-junction thermocouples. The air exhaust length 120 in FIG. 2 was 20.3 cm, the air exhaust vacuum was measured to be 280 mm water, and the cooling face velocity was measured at the midpoint of area 120 to be 530 meters per minute.

TABLE 1

| | Example No. | | | | | | |
|---|---|---|---|---|---|---|---|
| | C1 | 1 | C2 | 2 | C3 | 3 | 4 |
| | Polymer | | | | | | |
| | PET | PET | PET | PET | PLA | PLA | PET |
| Viscosity MFI (PLA) (g/10 min.) IV (PET) | 0.61 | 0.61 | 0.61 | 0.61 | 27 | 27 | 0.61 |
| Melt Temperature (° C.) | 291 | 291 | 297 | 297 | 218 | 218 | 297 |
| Polymer Flow Rate (g/cm/hour) | 107 | 107 | 178 | 178 | 178 | 178 | 178 |
| Die to Collector Distance (cm) | 24 | 24 | 30.5 | 30.5 | 34.3 | 34.3 | 30.5 |
| Die air Temperature (° C.) | 357 | 357 | 310 | 310 | 236 | 236 | 310 |
| Air volume (actual cubic meters/min.) | 8.8 | 8.8 | 9.1 | 9.1 | 4.2 | 4.2 | 9.1 |
| Collector speed (m/min.) | 1.6 | 1.67 | 2.4 | 2.3 | 4.1 | 4.1 | 2.4 |
| Average fiber diameter (micrometer) | 14.9 | 14.7 | 9.8 | 9.8 | 11.3 | 11.3 | |
| Basis weight ($g/m^2$) | 100 | 100 | 97 | 97 | 139 | 139 | 200 |
| Thickness or loft (bulk density) (mm) | 1.54 | 1.54 | 1.74 | 1.74 | 1.45 | 1.45 | 10.4 |
| Distance from TAB* (bottom) to collector (cm) | 1.9 | 1.9 | 1.9 | 1.9 | 1.9 | 1.9 | 1.9 |
| Slot width (cm) | 3.8 | 3.8 | 3.8 | 3.8 | 3.8 | 3.8 | 3.8 |
| Slot length (cm) | 55.9 | 55.9 | 55.9 | 55.9 | 55.9 | 55.9 | 55.9 |
| Heating face velocity (m/min) | 0 | 2600 | 0 | 2580 | 0 | 2630 | 2580 |
| Average zone temperature (° C.) | | 200.1 | | 151.0 | | 151.0 | 151.0 |

*Through Air Bonder

Shrinkage of Webs

Shrinkage of the webs was measured as a percentage of dimension loss from the initial sample dimensions. A sample of the web was die cut to a sample size of 10 cm square noting the machine direction of the web as prepared according to ASTM D 3776-96. The samples were tested according to ASTM D 1204-84. The samples were placed in an aluminum pan, which was lightly talced to prevent the sample from adhering to the pan. The sample was then placed in a convection oven held a constant temperature for 2 hours. The webs were removed from the oven and conditioned at approximately 22° C. and 50% relative humidity for 24 hours. The webs were measured and the percent shrinkage was calculated by taking the amount of shrinkage divided by the sample length for both dimensions. The results are reported in Table 2. The annealing treatment of the webs reduces the shrinkage to a useful level, where the webs are stable at temperatures above their treatment temperatures.

TABLE 2

| | Example No. | | | | | | |
|---|---|---|---|---|---|---|---|
| | C1 | 1 | C2 | 2 | C3 | 3 | 4 |
| Percentage shrinkage @ 150° C. MD^ (%) | 46 | 4 | 44 | 2 | 38 | 2 | 1 |
| Percentage shrinkage @ 150° C. CD* (%) | 49 | 4 | 48 | 2 | 34 | 1 | 1 |
| Average Shrinkage @ 150° C. (%) | 47.5 | 4 | 46 | 2 | 36 | 1.5 | 1 |
| Percentage shrinkage @ 180° C. MD (%) | | | 2 | | | | 2 |
| Percentage shrinkage @ 180° C. CD (%) | | | 2 | | | | 1 |
| Average Shrinkage @ 180° C. (%) | | | 2 | | | | 1.5 |
| Percentage shrinkage @ 200° C. MD (%) | | | 2 | | | | 1 |
| Percentage shrinkage @ 200° C. CD (%) | | | 1 | | | | 1 |
| Average Shrinkage @ 200° C. (%) | | | 1.5 | | | | 1 |

*CD (Cross Direction)

^MD (Machine Direction)

Molding of Webs

The molding capabilities of the webs of Examples 2 and 4 were examined by molding representative samples into a respirator-shaped cup shape using a 130° C. mold temperature as shown in Table 3. The molding procedure is described in U.S. patent application Ser. No. 11/461,192 (Fox et al.). A two layer sample of Example 2 and two samples of Example 4 (4(#1) and 4(#2)) were molded using a five second molding cycle. The mold was closed for five seconds and when the mold was opened, the sample was placed upon a room temperature mold for five seconds. The mold height was 5.7 centimeters and formed a generally oval shape with a minor axis of 11.5 centimeters and a major axis of 13 centimeters. There was a 0.5-centimeter gap between mold sections. The height of the molded cup was measured by clamping it to a table top, placing a flat blade on top of the molded cup, and measuring the distance from the table top to the knife blade. A 100 gram weight was then laid on the blade and the height measured again. Table 3 reports the mold temperatures and the height measurements. The webs of Examples 2 and 4 replicated well the mold shape even when molded at a temperature of 130° C. The molds of C1 and C2 tore when removed from the mold as a result of web shrinkage. The annealing treatment described in this disclosure provides for a moldable web, unlike that of the untreated webs.

TABLE 3

| Example No. | Mold Temperature (° C.) | Height (uncompressed) (cm) | Height (compressed) (cm) |
|---|---|---|---|
| 2 | 130 | 5.7 | 5.2 |
| 4 (#1) | 130 | 5.3 | 4.2 |
| 4 (#2) | 130 | 5.2 | 4.4 |

Various modifications and alterations of this invention will be apparent to those skilled in the art without departing from the scope and spirit of this invention, and it should be understood that this invention is not limited to the illustrative embodiments set forth herein.

What is claimed is:

1. A method for making a bonded nonwoven fibrous web comprising the sequential steps:

a) extruding melt blown fibers comprising a polymeric material;

b) collecting the melt blown fibers as an initial unbonded nonwoven fibrous web, wherein the fibers are substantially free of strain induced crystallization;

c) annealing the initial unbonded nonwoven fibrous web with a controlled heating and cooling operation comprising:

i) heating through the initial unbonded nonwoven fibrous web by forcefully passing through the initial unbonded nonwoven fibrous web a first fluid having a temperature above a cold crystallization temperature ($T_{cc}$) of the polymeric material of step a) to decrease the orientation of amorphous regions of the melt blown fibers, thereby providing a bonded nonwoven fibrous web; and ii) cooling through the bonded nonwoven fibrous web by drawing a second fluid having a temperature below a glass transition temperature ($T_g$) of the polymeric material of step a) over and through the bonded nonwoven fibrous web to retain the amorphous regions of the melt blown fibers providing a cooled bonded nonwoven fibrous web; and d) collecting the cooled bonded nonwoven fibrous web providing a dimensionally stable bonded nonwoven fibrous web;

wherein the melt blown fibers of the cooled bonded nonwoven fibrous web retain a substantial cold crystallization exotherm.

2. The method of claim 1, wherein melt blown fibers of the bonded nonwoven fibrous web are substantially unoriented.

3. The method of claim 1, wherein the initial unbonded nonwoven fibrous web, the bonded nonwoven fibrous web, the cooled bonded nonwoven fibrous web, and the dimensionally stable bonded nonwoven fibrous web are unrestrained.

4. The method of claim 1, wherein the shriankage of the dimensionally stable bonded nonwoven fibrous web is less than 4 percent relative to the initial nonwoven fibrous web.

5. The method of claim 1, wherein the melt blown fibers are at least monocomponent.

6. The method of claim 1, wherein the polymeric material is selected from the group consisting of polyesters, polyamides, cyclic polyolefins and combinations thereof.

7. The method of claim 1, wherein the polymeric material comprises poly(ethylene terephthalate).

8. The method of claim 1, wherein the polymeric material comprises poly(lactic acid).

9. The method of claim 1, wherein the diameter of the melt blown fibers is in a range of 1 micrometer to 20 micrometers.

* * * * *

UNITED STATES PATENT AND TRADEMARK OFFICE

CERTIFICATE OF CORRECTION

PATENT NO. : 8,802,002 B2
APPLICATION NO. : 11/617274
DATED : August 12, 2014
INVENTOR(S) : Michael Berrigan et al.

It is certified that error appears in the above-identified patent and that said Letters Patent is hereby corrected as shown below:

In the Claims

Column 17
Line 1, in Claim 4, delete “shriankage” and insert -- shrinkage --, therefor.

Signed and Sealed this
Thirty-first Day of March, 2015

Michelle K. Lee

Michelle K. Lee
*Director of the United States Patent and Trademark Office*